US005896142A

United States Patent [19]

Yamanaka

[11] Patent Number: 5,896,142

[45] Date of Patent: Apr. 20, 1999

[54] INK JET RECORDING APPARATUS WITH INCREASED-ENERGY PULSE DRIVE AFTER A RECORDING INTERRUPTION

[75] Inventor: Akihiro Yamanaka, Hiratsuka, Japan

[73] Assignee: Canon Kabushiki Kaisha, Tokyo, Japan

[21] Appl. No.: 08/943,014

[22] Filed: Oct. 2, 1997

Related U.S. Application Data

[63] Continuation of application No. 08/357,783, Dec. 16, 1994, abandoned, which is a continuation of application No. 07/908,954, Jul. 6, 1992, abandoned, which is a continuation of application No. 07/707,944, May 28, 1991, abandoned, which is a continuation of application No. 07/536,084, Jun. 11, 1990, abandoned, which is a continuation of application No. 07/365,675, Jun. 13, 1989, abandoned.

[30] Foreign Application Priority Data

Jun. 15, 1988 [JP] Japan ..... 63-145585

[51] Int. Cl.[6] ..... B41D 2/01

[52] U.S. Cl. ..... 347/14; 347/57

[58] Field of Search ..... 347/14, 19, 9, 347/185, 186, 188, 191, 194, 195, 57

[56] References Cited

U.S. PATENT DOCUMENTS

| | | | |
|---|---|---|---|
| 4,245,224 | 1/1981 | Tsayama | 347/10 |
| 4,266,232 | 5/1981 | Juliana | 347/10 |
| 4,275,402 | 6/1981 | Kern | 347/14 |
| 4,393,388 | 7/1983 | Matsuda | 347/14 |
| 4,415,904 | 11/1983 | Inoi | 347/188 X |
| 4,463,359 | 7/1984 | Ayata et al. | 347/56 |
| 4,567,488 | 1/1986 | Moriguchi | 346/76 PH |
| 4,574,293 | 3/1986 | Inui | 346/76 PH |
| 4,636,810 | 1/1987 | Asakura | 347/188 |
| 4,692,773 | 9/1987 | Saito | 347/15 |
| 4,737,860 | 4/1988 | Ono | 347/188 X |
| 4,791,435 | 12/1988 | Smith | 347/37 |
| 4,870,428 | 9/1989 | Kuwabara | 346/73 PH |
| 4,873,536 | 10/1989 | Minowa | 347/191 X |
| 4,876,559 | 10/1989 | Nishikawa | 347/12 |
| 5,172,130 | 12/1992 | Takahashi | 347/13 X |

FOREIGN PATENT DOCUMENTS

| | | | |
|---|---|---|---|
| 0145129 | 6/1985 | European Pat. Off. . | |
| 3525011 | 1/1986 | Germany | B41M 5/00 |
| 48551 | 4/1979 | Japan | B41J 3/04 |
| 2372 | 1/1985 | Japan | B41J 3/04 |
| 60-166461 | 8/1985 | Japan | B41J 3/04 |
| 208254 | 10/1985 | Japan | B41J 3/04 |
| 2169855 | 7/1986 | United Kingdom | B41J 3/04 |

OTHER PUBLICATIONS

Hanna, D.W; Scheduled Amplitude Drop–on–Demand Driver, IBM TDB, V26, No. 7A, Dec. 1983, p. 3136.

*Primary Examiner*—Joseph Hartary

*Attorney, Agent, or Firm*—Fitzpatrick, Cella, Harper & Scinto

[57] ABSTRACT

An ink jet recording apparatus comprises a driving circuit for sequentially supplying drive signals according to recording information and an ink jet recording head that deposits ink onto a recording medium in response to the drive signals. The apparatus determines if the supply of drive signals has been interrupted for a predetermined time period. If so, when the supply of drive signals resumes, a recording control circuit increases the energy of a predetermined number of drive signals. With this arrangement, the recording density can be maintained uniform, even if there are gaps in the recording information.

17 Claims, 6 Drawing Sheets

| FIG. 2A | FIG. 2B |
|---|---|

FIG. 5a
PRIOR ART
FIG. 5c
PRIOR ART
FIG. 5e
PRIOR ART
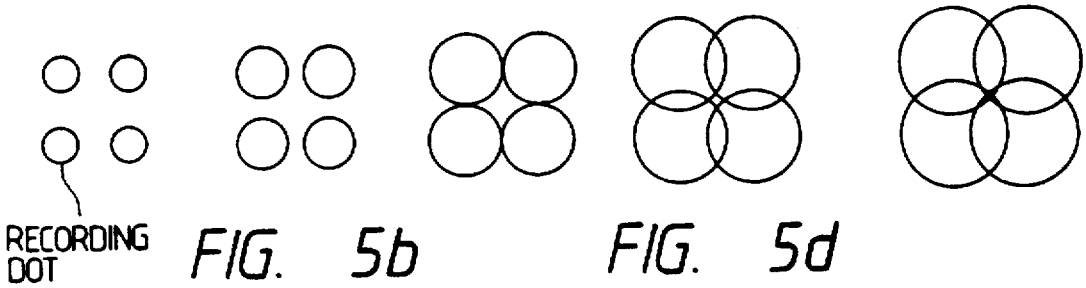
FIG. 5b
PRIOR ART
FIG. 5d
PRIOR ART
FIG. 6
PRIOR ART
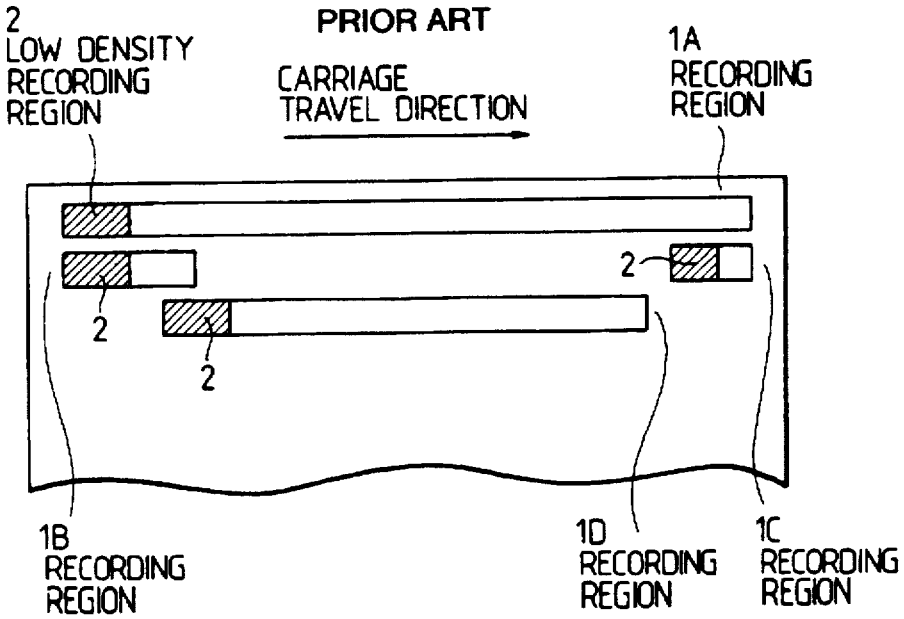

INK JET RECORDING APPARATUS WITH INCREASED-ENERGY PULSE DRIVE AFTER A RECORDING INTERRUPTION

This application is a continuation of application Ser. No. 08/357,783 filed Dec. 16, 1994, which was a continuation of application Ser. No. 07/908,954 filed Jul. 6, 1992, which was a continuation of application Ser. No. 07/707,944, filed May 28, 1991, which was a continuation of application Ser. No. 07/536,084, filed Jun. 11, 1990, which was a continuation of application Ser. No. 07/365,675, filed Jun. 13, 1989, all now abandoned.

BACKGROUND OF THE INVENTION

1. Field of the Invention

The present invention relates, in general, to an ink jet recording apparatus having sheet or liquid path for containing liquid as an ink container, and provides an advantageous technique in particular for an ink jet recording apparatus equipped with a recording head of bubble jet type which generates bubbles by rapid heating with the electro-thermal converting element thereby emitting ink droplets.

2. Related Background Art

A recording head of the bubble jet type, utilizing bubbles generated by thermal energy as the ink droplet forming means, is capable of significantly reducing the area of activating element, thereby realizing a high-density and compact recording head and eventually compactizing the recording apparatus.

Also the fluctuation in the function among different heads can be reduced since the electro-thermal converting elements can be precisely formed with a photolithographic process.

Next, U.S. Pat. Nos. 4,376,945 and 4,719,472 disclosing a technique for desirably recording with liquid temperature maintained constant are known as a preliminary heating technique of the ink jet recording apparatus. Further, as a technique for modifying the preliminary heating according to an environmental condition or sequence for conducting preliminary heating necessarily on turning on a main switch, British patent 2159465B and British publication 2169855A disclose a speed heating by increasing preliminary heating pulse width without liquid emission.

Among those preliminary heating systems, one disclosed in U.S. Pat. No. 4,463,359 is to add pulse for preliminary heating to the drive pulse for recording and is a very important and advantageous invention as a technique for achieving stabilized recording.

While, as a technique for preliminary emission independent of actual recording, there are British patent 2159465B and British patent publication 2169855A that disclose more concrete examples of an ink jet technique to stabilize recording in accordance with an environmental condition.

As described in the above, in the field of the ink jet recording, excellent preliminary emission means is known and used as shown in the above documents.

Problems not noticed in the above documents have been found after extensive research. The background of the present invention is described as follows. That is, an ink jet recording apparatus, particularly the recording head of serial type, often provides, in the recorded image, a record area of lower density in comparison with other areas.

FIG. 6 shows a sample of recording with a conventional bubble jet recording apparatus, for explaining the above-mentioned phenomenon, wherein 1A–1D are recording regions, including regions 2 of lower density. There is employed a recording head of serial type, which effects recording by scanning motions in a direction indicated by an arrow. As will be apparent from this figure, the lower density appears at the start of recording of each line, and at the start of recording after an unrecorded region.

The cause of this phenomenon will be explained in the following, with reference to FIGS. 4 and 5.

FIG. 4 shows the change in the diameter of recording dots, as the function of lapse of time in each of the recording regions 1A–1D shown in FIG. 6. It will be apparent, from this figure, that the diameter of recording dots varies considerably between the start and end of the recording in a scanning line.

A cause of this phenomenon is that, in a recording head of bubble jet type, a large electric power has to be applied instantaneously to a electro-thermal converting element for generating the bubble, and the heat dispersion is not conducted sufficiently because of the high-speed drive, so that the electro-thermal converting element and the ink are heated with the lapse of recording time, thus causing a change in the rate of expansion or contraction of bubbles and in the viscosity of ink.

However, in the actual recording, the change in the diameter of recorded dots is not directly reflected in the change in the density of recorded image. More specifically, if the ratio of the actual area of dots to the area of pixel in which said dots are placed (said ratio being hereinafter referred to as the area factor) is low, the density of the pixel is influenced by the low density, for example white, of the background of the recording sheet, and the record density is lowered. Thus, when the area factor is relatively small as shown in FIGS. 5(a) to (c), the change in the diameter of recording dots significantly affects the density of the recorded image. On the other hand, when the diameter of recording dots is increased to an area factor of about 100% as shown in FIGS. 5(d) and (e), the density of the recorded image is not too much affected by a slight change of the diameter of recording dots.

Consequently the use of a larger dot diameter is preferable for reducing the change in the image density, but an excessively large dot diameter is not desirable becuase of requires an excessively long time for the ink to be fixed on the sheet. Thus, if the dot diameter is so selected as to ensure rapid fixing even at the end of a scanning line where the dot diameter increases, the area factor decreases in the pixels in the initial portion of the recording, thus resulting a decrease in the recorded image density.

SUMMARY OF THE INVENTION

The object of the present invention, attained in consideration of the foregoing, is to provide an ink jet recording apparatus capable of avoiding the decrease in the density of recorded image in the initial period of recording, by controlling the electric power of pulses supplied to the electro-thermal converting elements.

A further object of the present invention is to provide the ink jet recording apparatus comprising a recording head for emitting ink thereby forming a record on a recording surface by electric pulse supply to an electrothermal converting element according to recording data; recordless period detecting means for detecting the absence of input of recording data of a predetermined number in consecutive manner; and pulse power control means for varying the electric power of said electric pulses of a predetermined number in response to said detection by said recordless period detecting means.

A still further object of the present invention is to provide an ink jet recording apparatus comprising a recording head for emitting ink thereby forming a record on a recording surface by electric pulse supply to an electro-thermal converting element according to recording data; recordless period detecting means for detecting the absence of input of said recording data for a predetermined period; and pulse power control means for varying the electric power of said electric pulse for a predetermined period in response to said detection by said recordless period detecting means.

A further object of the present invention is to provide an ink jet recording apparatus which can maintain constant image quality printed during carriage traveling for printing or during printing medium traveling of full line type with a fixed recording head. The ink jet recording apparatus which can achieve the object according to the present invention are for example an ink jet recording apparatus comprising, driving means for outputting drive signal according to recording information signal, ink jet recording means for emitting ink to a recording medium according to the drive signal from said driving means so that recording is performed, means for determining whether a ratio of the drive signal supplied to said ink jet recording means to a time is smaller than a predetermined value or not, and recording control means for increasing a quantity of energy of the drive signal from said drive means when it is determined by said means for determining that the ratio is smaller, thereby said ink jet recording means conducts recording according to the drive signal of the energy increased by said recording control means and an ink jet recording apparatus comprising, an ink jet recording means for emitting ink toward a recording medium according to drive signal, and a control means increasing quantity of drive signal energy during an initial mode for conducting print for a predetermined term or for conducting predetermined number of ink emission when said ink jet recording means conducts recording continuously, so that the quantity of the drive signal energy at the initial mode is greater than that of an intermediate mode for printing for term longer than the predetermined term or for conducting ink emission more than predetermined number of ink emission.

According to the above-explained structures, the electric power of the pulses supplied to the electro-thermal converting element is increased, thereby increasing the diameter of recording dot, in a predetrmined period, in the initial stage of recording, following the absence of recording for a predetermined period.

BRIEF DESCRIPTION OF THE DRAWINGS

FIG. 5 is a schematic view showing area factors in different dot diameters;

FIG. 6 is a plan view of a record sample obtained with a conventional apparatus.

DESCRIPTION OF THE PREFERRED EMBODIMENTS

In the following there will be given a detailed explanation on an embodiment of the present invention, while referring to the attached drawings.

Figure 7:
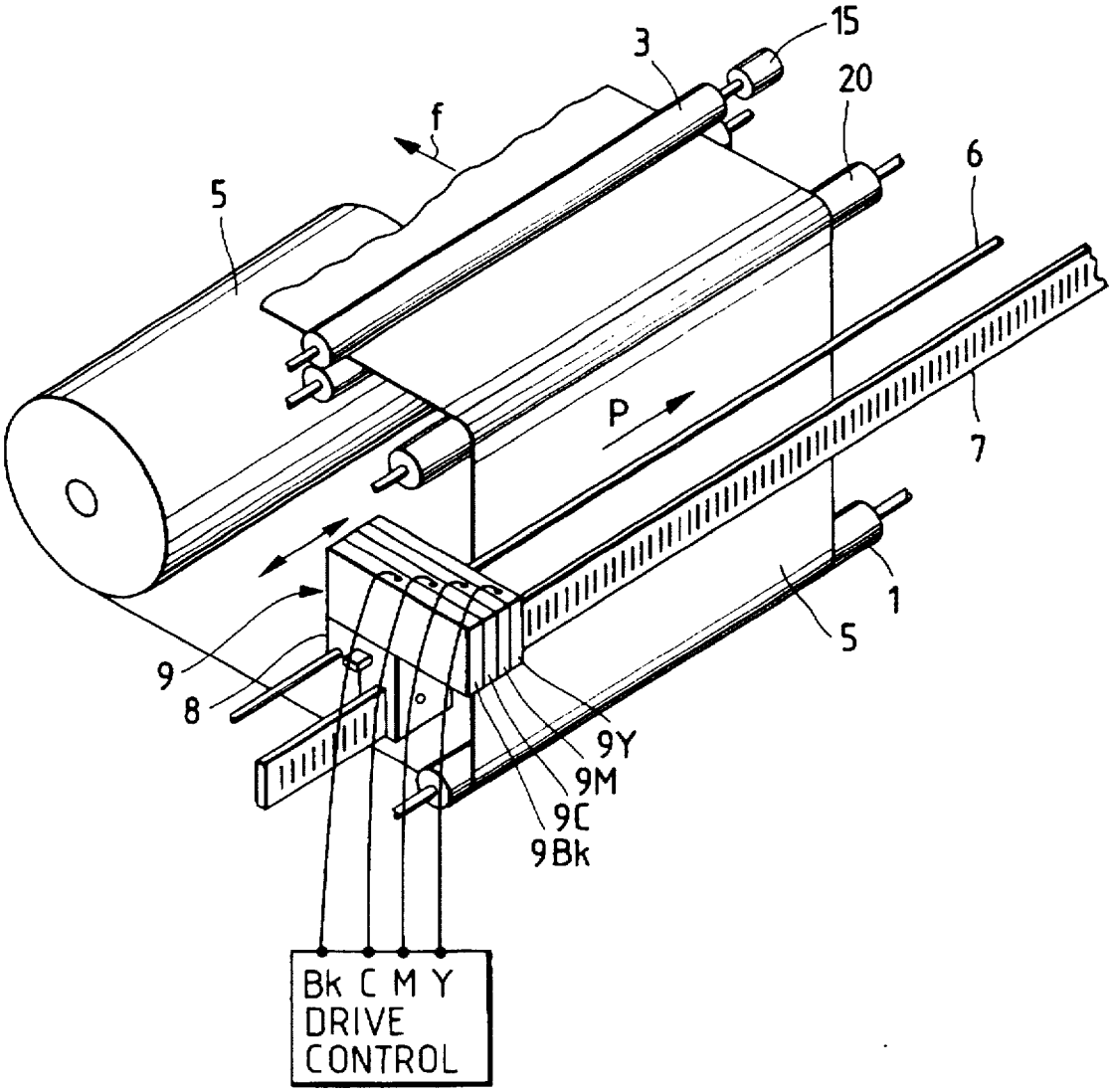
FIG. 7 is a schematic perspective view of a serial type ink jet recording apparatus according to the present invention.

FIG. 7 shows a schematic perspective view of the ink jet recording apparatus according to a substantial part of the present invention. In FIG. 7, the member 5 to be recorded as a recording medium wound into a roll is fed via a carrying rollers 10 and 20, is sandwiched by a feed roller 3, and is fed in a direction f in FIG. 7 according to a driving by a sub-traveling motor 15 coupled to the feed roller 3. Guide rails 6 and 7 are positioned in parallel across the recording member 5. The recording head unit 9 mounted by the carriage travels to right and to left. Four heads (9Y, 9M, 9C, 9B$_k$) of yellow, magenta, cyan, and black and mounted on the carriage 8. Four color ink tanks are arranged for them. The recording medium 5 is fed intermittently at a recording width of the recording head 9. When the recording medium 5 is stopped, the recording head 9 travels in a direction P and emits ink droplet according to an image signal.

Figure 1:
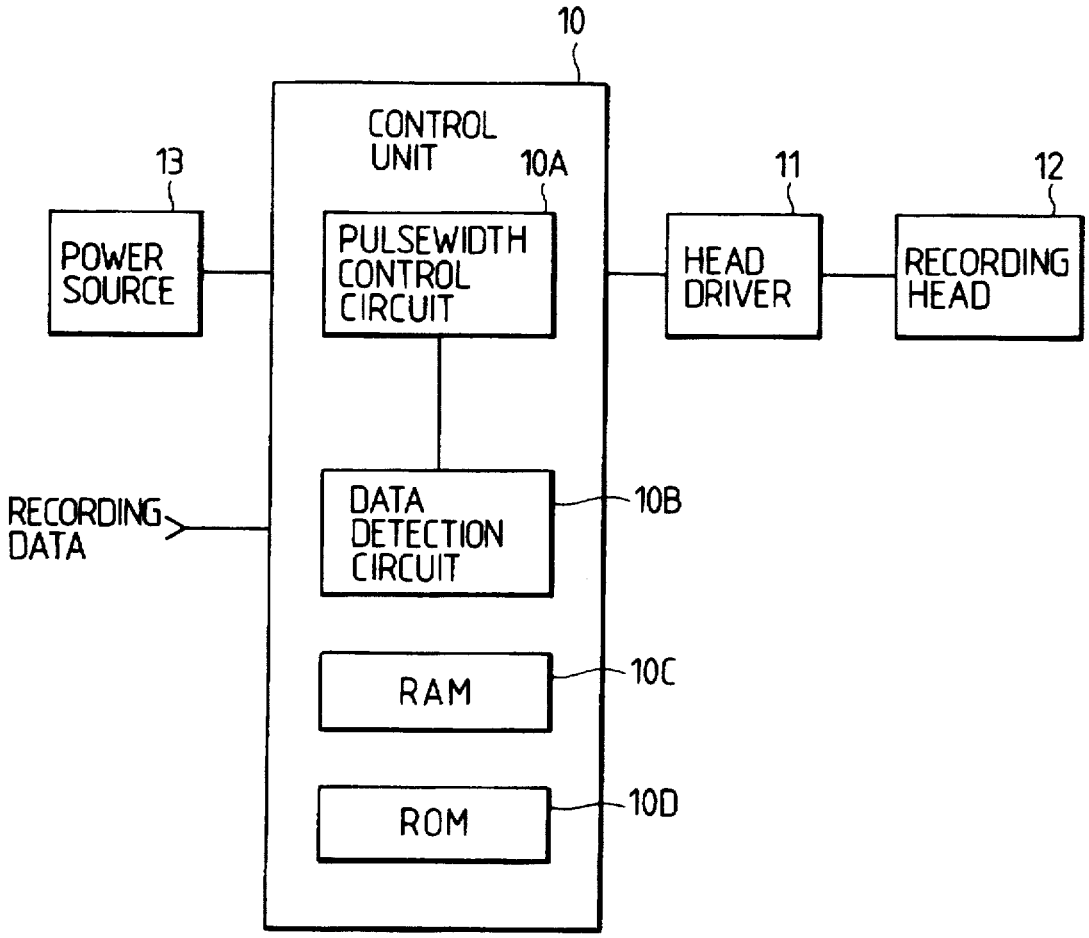
FIG. 1 is a block diagram of an embodiment of the ink jet recording apparatus of the present invention.

FIG. 1 is a block diagram of the control system in an embodiment of the ink jet recording apparatus of the present invention, wherein a control unit 10 is provided with a data detection circuit 10B for detecting, at every predetermined number of clock pulses, the presence or absence of recording data in a data block signal which is supplied for example from a host computer in synchronization with said clock pulses and is capable of transmitting recording data of a predetermined unit; and a pulse width control circuit 10A for changing the energy-determining magnitude of the pulses by setting the width of pulses supplied to the electro-thermal converting element in a recording head 12, according to the number of clock pulses for which the absence of recording data is detected by said data detection circuit 10B. The control unit 10 is further provided with a RAM 10C used as a work area for control numbers m, n to be explained later, and a ROM 10D for storing a program for the control sequence to be explained later in relation to FIG. 2. A head driver 11 composed of registers, latches etc. drives the recording head 12 according to the recording data processed in the control unit 10. A power source 13 is provided for supplying various units of the ink jet recording apparatus with electric power.

The control unit 10 is naturally used also for controlling other elements of the ink jet recording apparatus, for example those for carriage movement or sheet feeding.

Figures 2, 2A:
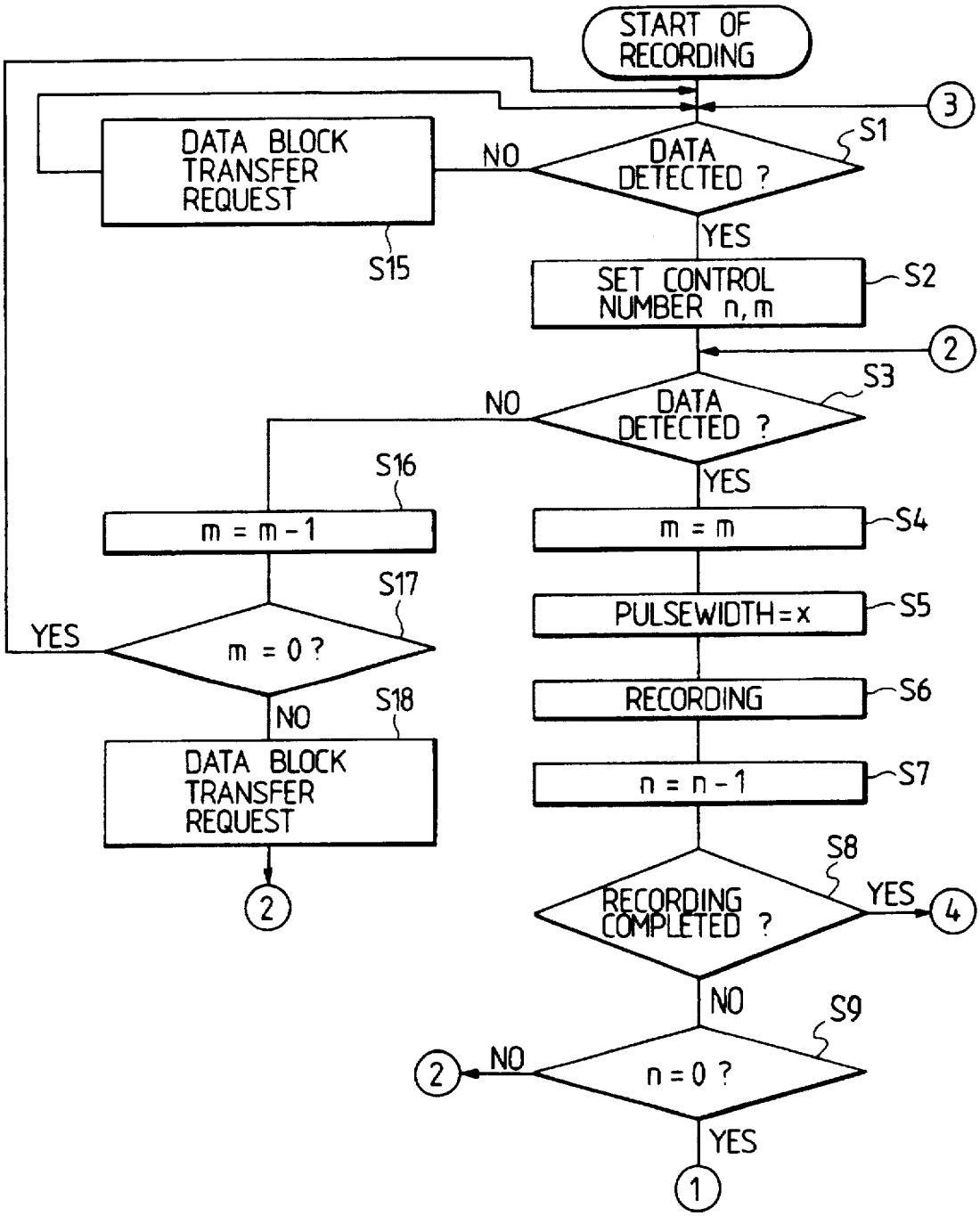
FIGS. 2, 2A and 2B are a flow chart of the control sequence of an embodiment of the present invention.
Figure 2B:
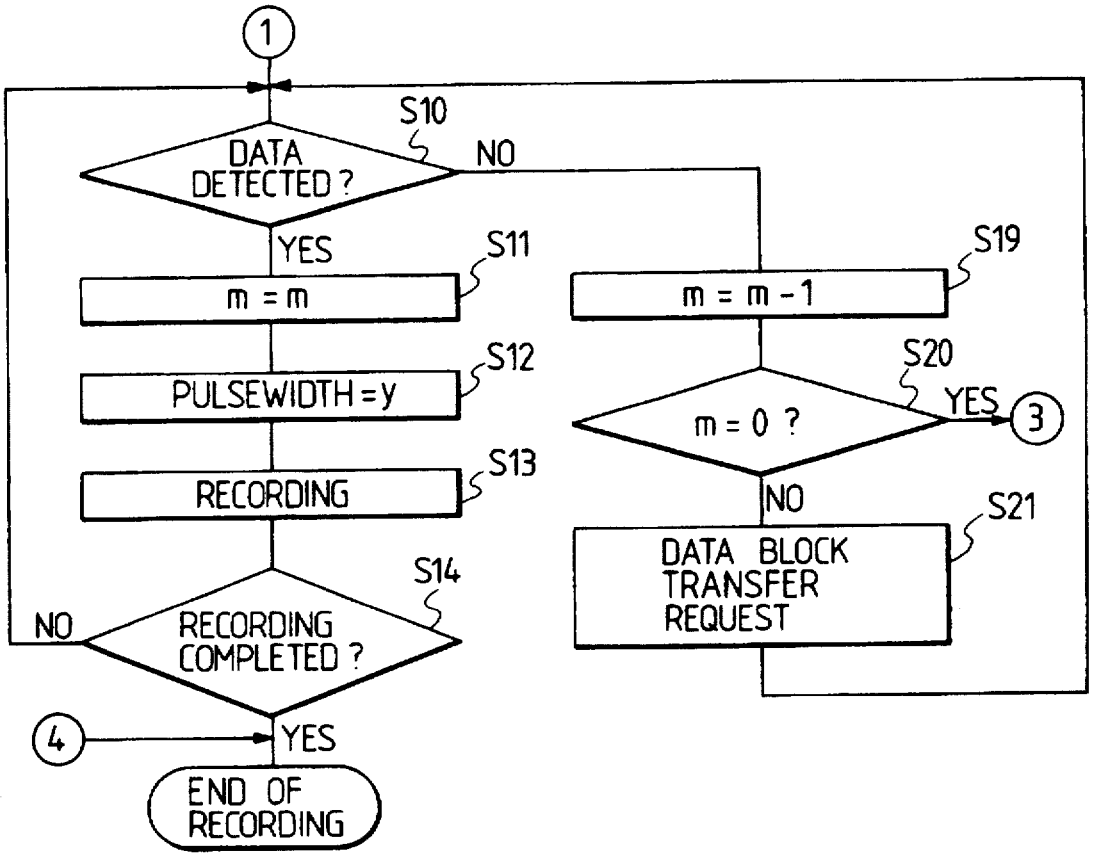

FIG. 2 is a flow chart of the control sequence of an embodiment of the present invention, for pulse width control, in the absence of input of recording data of a predetermined number.

In response to the input of a record start signal for example from a host computer, a step S1 discriminates the presence or absence of recording data, by the logic level "H" or "L" of a data block signal for transmitting a block of recording data, for example those of a pixel, in synchronization with a clock pulse, and, in case of absence of recording data, a step S15 requests the transfer of the data block signal. On the other hand, if the presence of recording data is identified, a step S2 sets predetermined control numbers n, m, wherein n indicates the number of clock pulses corresponding to the recording data for which the width pulses to be supplied to the electro-thermal converting element is to be varied, while m indicates the number to be utilized in the control for varying the pulse width in case of m consecutive clock pulses corresponding to data block signals without the recording data.

A step S3 discriminates the presence or absence of recording data in the data block signal, and, in the absence of the recording data, a step S16 decreases the value of m by one, and a step S17 discriminates whether m is equal to zero.

If not equal to zero, a step S18 requests the next data block signal, and the sequence returns to the step S3. If the step S17 identifies m=0, the sequence returns to the step S1. That is, the identification of m=0 is in effect a determination that the ratio of (1) a value related to the duration of an interruption in the sequential supply of recording data to (2) a value related to a reference time period, is larger than a predetermined value.

Figure 3:
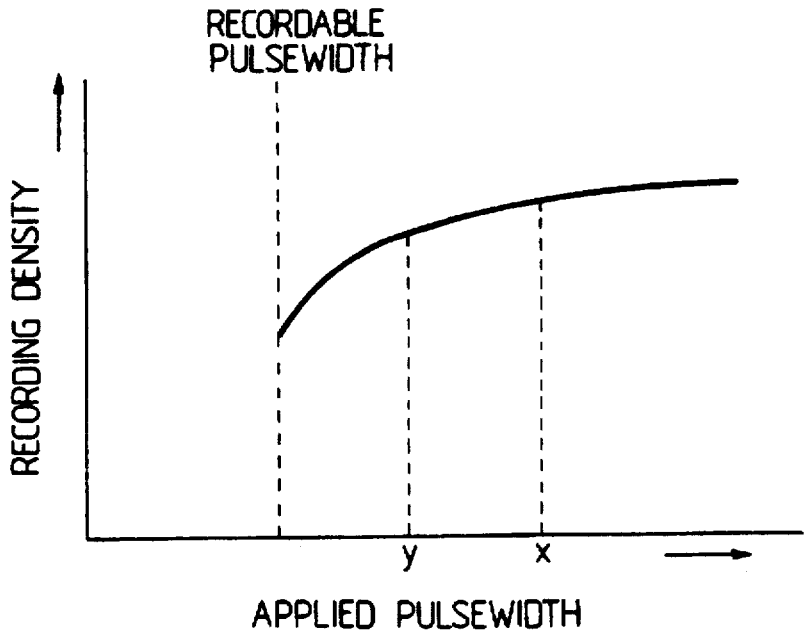
FIG. 3 is a chart showing the relationship between the applied pulse width and the record density.
Figure 4:
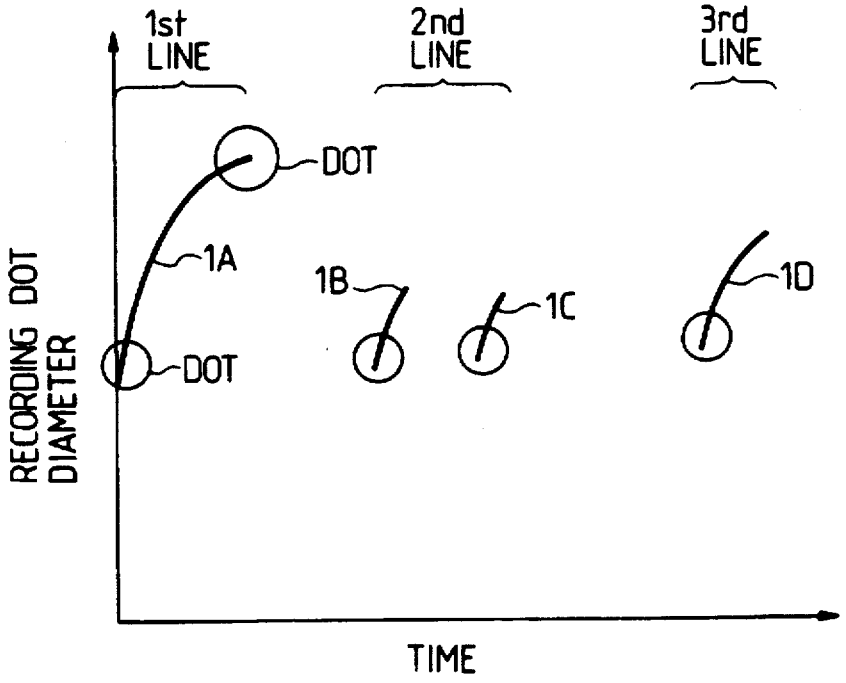
FIG. 4 PRIOR ART
FIG. 4 is a chart showing the change in the dot diameter with the progress of recording.

On the other hand, if the step S3 identifies the presence of recording data, a step S4 sets m=m, and a step S5 sets the pulse width at a value x. Said set pulse width x is larger than the pulse width y employed in the normal recording as shown in FIG. 3, and said wider pulse width enables an increase in the density of the recorded image in the initial stage of recording of a scanning operation, or at the restart of recording after an interruption in the recording.

Then a step S6 effects the recording operation with the pulse width x, and a step S7 decreases the value of n by one. The recording with the pulse width x is continued until a step S8 detects a record end signal or a step S9 identifies n=0.

If the step S9 identifies n=0, indicating the completion of recording operations of n times, the sequence proceeds to a step S10 for effecting the recording with the ordinary pulse width y. Steps S10 to S13 and S19 to S21 are similar to the steps S3 to S6 and S16 to S18, respectively, but in this case there is set the normal recording pulse width y, and the sequence returns to the step S10 after the step S21. Also after the process of the step S13, the step S14 discriminates whether the recording has been completed, and, if not, the sequence returns to the step S10 for continuing the recording operation with the normal pulse width y.

When the above-explained process is applied for example to a recording mode shown in FIG. 6, in the recording of the first line, the control number n is so determined that a region 2 is recorded with the pulse width x, and the remaining region is recorded with the pulse width y. During the sheet feeding (carriage return) after the recording of the first line, there is no transfer of the recording data. Thus, if the number m is so selected as to reach 0 during this period, the region 2 in the recording region 1B of the second line is recorded with the pulse width x. Also by suitable selection of the value m, in a dataless region as in the second line, the value m decreases and reaches zero, and at the re-start of recording the region 2 of the recording region 1C is recorded with the pulse width x.

As explained in the foregoing, the unevenness in recording density in the initial stage of recording operation can be reduced, since the recording is made with a larger pulse width in the regions 2, shown in FIG. 6, where the recording density tends to become lower.

In the present embodiment, the control numbers n, m and pulse widths x, y shown in Table 1 were experimentally determined.

TABLE 1

| | Optimum value |
|---|---|
| Control number n | 50–200 pulses (head nozzle density 300 DPI, driving frequency 4 kHz) |
| Control number m | 30–200 pulses (head nozzle density 300 DPI, driving frequency 4 kHz) |
| Pulse width x | y × 1.01–1.1 (head nozzle density 300 DPI, driving frequency 4 kHz, pulse width y 7–10 μs) |

In the foregoing embodiment, the pulse width x is constant during the period corresponding to the control number n, but more uniform density control is possible if the value x is rendered variable as a function of n. For example such control is possible by setting the pulse width at a maximum value at n=n, then gradually decreasing the pulse width along with the decrease to reach the pulse width y at n=0.

In the foregoing embodiment the decrease in density of the recorded image at the start of recording in each line is resolved by the control of pulse width, but a similar effect can be obtained by the control on the voltage applied to the electro-thermal converting element such as the heat-generating resistor.

Also in the foregoing embodiment the control numbers n, m represent the number of pulses, but they may also represent periods of time corresponding to said numbers of pulses.

Furthermore the foregoing embodiment is easily practicable as it does require complex control circuit.

As will be apparent from the foregoing description, according to the embodiment, the diameter of recording dots increases, through the increase in the electric power of pulses supplied to the electro-thermal converting element, in a predetermined period in the initial stage of recording operation, following the absence of recording for a predetermined period.

Thus it is rendered possible to avoid the decrease in the recorded image density in the initial stage of recording operation, and thus to reduce the unevenness in the density.

The present invention provide excellent performance particularly in the recording head or recording apparatus of a bubble jet type among ink jet recording systems.

Typical structure of this type shown in U.S. Pat. Nos. 4,723,129, and 4,740,796 using an essential principle is desirable for the present invention. In concrete, the electro-thermal converter arranged corresponding to a sheet or liquid path containing liquid (ink) generates thermal energy according to a drive signal to speedly increase temperature so that boiling above the nucleate boiling region occurs responsive to a recording information; that is, a film boiling occurs at a heating surface of the recording head. As a result, bubbles in a liquid (ink) corresponding to drive signals respectively one to one. In case that the drive signal is pulse, since suitably the bubbles contract immediately, the liquid (ink) emission of highly excellent response can be achieved desirably. As such drive signal, one disclosed in U.S. Pat. Nos., 4,463,359 and 4,345,262 is suitable. When the condition disclosed in U.S. Pat. No. 4,313,124 is used as a technique to define the temperature increasing ratio at the heating surface, further preferable recording can be obtained.

As a construction of recording head, combination of an orifice, the liquid path, and the electro-thermal converter (linear liquid path or eight angled liquid path) and another having heating unit arranged in a concaved region as disclosed in U.S. Pat. Nos. 4,558,333 and 4,459,600 is within a scope of the present invention. Further, the present invention is effective in the structure disclosed in Japanese Patent Laid-Open No. 59-123670 wherein the orifice of the electro-thermal converter is a common slit of plurality of the electro-thermal converters and disclosed in Japanese Patent Laid Open No. 59-138461 wherein an opening absorbing thermal energy pressure wave corresponds to the orifice.

Further, as a recording head of a full line type having a length corresponding to a maximum width on which printing is possible on the recording medium, a structure as shown in the above documents wherein the length is filled with plurality of recording heads and a structure of integrally formed single recording head can be used in the present invention to effectively achieve the above described advantage.

Next, it is desirable to add recovery means of the recording head, and preliminary auxiliary means, since the performance of the present invention can be made stable. They are, for example, capping means, cleaning means, pressure and absorbing means, electro-thermal converter or another heating element or combination thereof, and preliminary emission means for non-recording emission are desirable. Further, the present invention can be used in a recording apparatus having not only a recording mode for major color such as black but also at least one of recording modes for a full color such as complex color recorded by different color inks or such as mixed color produced by mixing plurality of colors.

The above described present invention is summarized as follows. The present invention is characterized in that when term during which continuous printing is not conducted is longer than a predetermined time, when continuous recording information inputted into a predetermined liquid emission unit or predetermined plurality of divided group of unit is not greater than a predetermined number, or when recording during an initial term after turning on the main switch is conducted, recording is conducted according to a drive signal of a quantity of energy greater than that of the drive signal for stable printing.

In other words, recording modes for actual recording on the basis of the above standard includes initial recording mode for recording according to a drive signal with relatively increased energy quantity and intermediate recording mode following to the initial recording mode. The intermediate recording mode is conducted by a relatively smaller quantity of energy.

In the above embodiment, the recording information is supplied to recording head. Plurality of electro-thermal converters of the recording head are divided into plurality of groups. For each group, on the basis of existence and nonexistence or number of the recording information signals, the term during which the signal is not supplied is determined. Usage of the embodiment for each group is desirable.

Above described increasing of energy step by step is explained as follow. Table 2 shows as an example, a discrimination means having three determination means of m-control number. An example 1 is to increase applying pulse width reduction according to reducing control number m. An example 2 is to equalize the pulse width reduction, when mo (maximum value of m) is 20, three stages are used. When mo is 40, two stages are used.

TABLE 2

| n | Pulse Width (Example 1) | Pulse Width (Example 2) |
|---|---|---|
| 200~51 | y × 1.1 | y × 1.05 |
| 50~21 | y × 1.08 | y × 1.03 |
| 20~1 | y × 1.04 | y × 1.01 |

As described in the above, since the quantity of energy is modified step by step according to the term during which the recording signal is not supplied and to a number of pulses, the recording density is homogenized. It is also desirable to change continuously the quantity of energy according to variable, control number m. In concrete, on the basis of a ratio to the maximum value mo, the pulse width corresponding to increasing energy is reduced according to a reduction of m. With regard to a function of control, when the correction factor of the pulse width relative to the standard pulse width $y_0$ is 1.1, ($y_0 \times 1.1 \times m/mo$) is used as a pulse width for five control, or natural number $y_0 \times (1.1 \times (m/5) \times 0.01)$ with gauss symbol is used as a pulse width for five control. Since the longer term for increasing the energy of applied pulse is not desirable, it is preferable to provide limiter means of one fourth or fifth of the line printing length (maximum) to obtain a stopper effect as a erroneous control operation preventing mechanism.

In any event, since the present invention increases the quantity of energy of drive signal at the initial drive forcedly to obtain greater diameter of recording dot according to the variable with regard to time, such as drive signal pulse number or the result of the operation of predetermined standard descrimination means, uneven density of recorded image is compensated. Accordingly, high quality of recording image can be obtained.

I claim:

1. An ink jet recording apparatus comprising:

driving means for outputting a plurality of drive signals corresponding to recording information, each said drive signal having a certain energy-determining magnitude which reflects at least one of a voltage and a width of each said drive signal;

ink jet recording means for depositing an ink onto a recording medium, said ink jet recording means having at least one electrothermal converter, said ink jet recording means being driven to deposit said ink in response to said drive signals, said drive signals being supplied in a sequence from said driving means to said ink jet recording means in order to perform recording in accordance with the energy-determining magnitudes of said drive signals, said drive signals being supplied to at least one said electrothermal converter;

determining means for determining whether a ratio of (1) a value corresponding to a duration of an interruption in the sequence of said drive signals which are supplied to said ink jet recording means to (2) a value corresponding to a reference time period, exceeds a predetermined value, said predetermined value being sufficient such that heat produced by said ink jet recording means is dissipated; and recording control means for controlling recording, wherein said recording control means increases the energy-determining magnitude that reflects at least one of said voltage and said width of each said drive signal supplied to said ink jet recording means after the interruption of said drive signals when the determining means determines that the ratio exceeds the predetermined value, and wherein said recording control means decreases the energy-determining magnitude that reflects at least one of said voltage and said width of each said drive signal after a predetermined number of said drive signals having an increased said energy-determining magnitude have been supplied to said ink jet recording means, wherein said predetermined number is selected so that heat is accumulated in said ink jet recording means, thereby keeping said quantity of ink emitted constant, and wherein said recording control means increases the energy-determining magnitude that reflects at least one of said voltage and said width of each said drive signal supplied to said ink jet recording means just after a start of a recording operation.

2. An ink jet recording apparatus according to claim 1, wherein the ratio corresponds to a time interval during which said drive signals are not supplied to said recording means.

3. An ink jet recording apparatus according to claim 2, wherein the time interval is measured by counting a clock pulse.

4. An ink jet recording apparatus according to claim 1, wherein said recording control means increases the energy-determining magnitude of said drive signal stepwise according to discrete changes in the reference time period.

5. An ink jet recording apparatus according to claim 1, wherein said recording means includes an electrothermal converter, and said drive signal is a pulse signal for causing film boiling at a heating surface of said electrothermal converter.

6. An ink jet recording apparatus according to claim 1, wherein said ink jet recording means comprises a plurality of said electrothermal converters divided into more than two groups, and said determining means conducts the determination for each group, and said drive signal is a pulse signal for causing film boiling at a heating surface of each said electrothermal converter.

7. An ink jet recording apparatus according to claim 1, wherein said drive signal is a pulse signal of constant voltage for causing film boiling at a heating surface of said electrothermal converter, and said recording control means increases the energy-determining magnitude of said drive signal by increasing a pulse width thereof.

8. An ink jet recording apparatus according to claim 1, wherein said recording control means increases the energy-determining magnitude of said drive signal at an initial recording after a power source of said ink jet recording apparatus has been turned on.

9. An ink jet recording apparatus according to claim 8, wherein said recording means is carried by a carriage for linewise recording by traversing the recording medium, and a period of time during which the energy-determining magnitude of said drive signal is increased after the power source has been turned on is not more than one fifth of a continuous line of recording.

10. An ink jet recording apparatus comprising:

a recording head for emitting an ink and thereby forming an image on a recording surface in response to an application of a plurality of electric pulses to an electrothermal converting element according to a recording data;

recordless period detecting means for detecting a recordless period during which a predetermined consecutive amount of the recording data is not applied to said electrothermal converting element; and pulse power control means for increasing at least one of a voltage and a width of a predetermined number of those of said electric pulses which are supplied to said recording head after resumption of the recording data when said recordless period detecting means detects the absence of the predetermined consecutive amount of the recording data, and for decreasing at least one of said voltage and said width of those of said electric pulses which are supplied to said recording head after a predetermined amount of recording with the electric pulses having the at least one of increased said voltage and said width, wherein said predetermined number is such that heat is accumulated in said recording means, thereby keeping said quantity of ink emitted constant, and wherein said pulse power control means increases at least one of the voltage and the width of those of the electric pulses supplied to said recording head just after a start of a recording operation.

11. An ink jet recording apparatus according to claim 10, wherein the energy of the electric pulses is changed by varying a pulse width thereof.

12. An ink jet recording apparatus comprising:

a recording head for emitting an ink and thereby forming an image on a recording surface, said recording head having at least one electrothermal converting element, said recording head emitting said ink in response to an application of a plurality of electric pulses to at least one said electrothermal converting element according to a recording data;

recordless period detecting means for detecting an absence of the recording data for a given recordless time period; and pulse power control means for increasing at least one of a voltage and a width of the electric pulses for a predetermined time period after resumption of the recording data when said recordless period detecting means detects the absence of the recording data for the given time period and for decreasing at least one of said voltage and said width of those of said electric pulses which are supplied after a predetermined amount of recording with the electric pulses having the at least one of the increased said voltage and said width, wherein said predetermined number is such that heat is accumulated in said recording means, thereby keeping said quantity of ink emitted constant, and wherein said pulse power control means increases at least one of the voltage and the width of those of the electric pulses supplied to said recording head just after a start of a recording operation.

13. An ink jet recording apparatus according to claim 12, wherein the energy of the electric pulses is changed by varying a pulse width thereof.

14. An ink jet recording apparatus according to claim 12, wherein the energy of the electric pulses is changed by varying a voltage thereof.

15. An ink jet recording apparatus comprising:

ink jet recording means for emitting an ink toward a recording medium according to a plurality of drive signals supplied to an electrothermal transducer, each said drive signal having a predetermined energy-determining magnitude which reflects at least one of a voltage and a width; and control means for controlling recording, wherein said control means increases the energy-determining magnitude that reflects at least one of said voltage and said width of each said drive signal during an initial printing mode for conducting printing for at least one of a predetermined term and a predetermined number of ink emissions when said ink jet recording means conducts recording continuously, so that the energy-determining magnitude of the drive signals during the initial printing mode is greater than that during an intermediate printing mode for printing for a term longer than the predetermined term or for conducting more than a predetermined number ink emissions and for thereafter decreasing the energy-determining magnitude of the drive signals, wherein said predetermined number is such that heat is accumulated in said recording means, thereby keeping constant said quantity of ink emitted, and wherein said recording control means increases the energy determining magnitude that reflects at least one of said voltage and said width of each said drive signal supplied to said ink jet recording means just after a start of a recording operation.

16. An ink jet recording apparatus according to claim 15, wherein the initial printing mode conducts printing for a predetermined time period.

17. An ink jet recording apparatus according to claim 15, wherein the initial printing mode conducts printing for a predetermined number of emissions.

* * * * *

UNITED STATES PATENT AND TRADEMARK OFFICE

CERTIFICATE OF CORRECTION

PATENT NO. : 5,896,142

DATED : April 20, 1999

INVENTOR(S) : AKIHIRO YAMANAKA

It is certified that error appears in the above-identified patent and that said Letters Patent is hereby corrected as shown below:

ON THE TITLE PAGE

[54] "PULSE DRIVE" should read --DRIVE PULSE--.

COLUMN 1 line 2, "PULSE DRIVE" should read --DRIVE PULSE--.

COLUMN 2 line 42, "becuase of" should read --because it--.

COLUMN 3 line 39, "emission." should read --emissions.--; and
line 49, "a flow chart" should read --flowcharts--.

COLUMN 4 line 4, "via a" should read --via--;
line 11, "and" should read --are--; and
line 16, "droplet" should read --droplets--.

UNITED STATES PATENT AND TRADEMARK OFFICE

CERTIFICATE OF CORRECTION

PATENT NO. : 5,896,142

DATED : April 20, 1999

INVENTOR(S) : AKIHIRO YAMANAKA

It is certified that error appears in the above-identified patent and that said Letters Patent is hereby corrected as shown below:

COLUMN 6 line 27, "provide" should read --provides--.

COLUMN 7 line 28, "to the" should read --the--;
line 39, "follow." should read --follows.--;
Table 2, "n" should read --m--;
line 55, Insert: --y: Pulse width of standard drive signal preliminary determined for each apparatus in order to conduct stabilized printing.--; and
line 65, "$(y_o x1.1x^n/_{no})$" should read --$(y_o x1.1x^m/_{mo})$--.

COLUMN 8 line 4, "as a " should read --as an--.

UNITED STATES PATENT AND TRADEMARK OFFICE

CERTIFICATE OF CORRECTION

PATENT NO. : 5,896,142

DATED : April 20, 1999

INVENTOR(S) : AKIHIRO YAMANAKA

It is certified that error appears in the above-identified patent and that said Letters Patent is hereby corrected as shown below:

COLUMN 10 line 48, "number" should read --number of--.

Signed and Sealed this

Twenty-sixth Day of September, 2000

*Attest:*

Q. TODD DICKINSON

*Attesting Officer*

*Director of Patents and Trademarks*